US006213169B1

(12) United States Patent
Clüsserath

(10) Patent No.: US 6,213,169 B1
(45) Date of Patent: Apr. 10, 2001

(54) SINGLE-CHAMBER FILLING SYSTEM

(75) Inventor: Ludwig Clüsserath, Bad Kreuznach (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 0 days.

(21) Appl. No.: 09/299,497

(22) Filed: Apr. 26, 1999

(30) Foreign Application Priority Data

Apr. 27, 1998 (DE) ..... 198 18 761

(51) Int. Cl.[7] ..... B67C 3/10

(52) U.S. Cl. ..... 141/49; 141/6; 141/7; 141/40; 141/44; 141/48; 141/52; 141/54; 141/63

(58) Field of Search ..... 141/5–7, 39, 40, 141/44–50, 52, 53, 54, 56, 57, 63, 302, 306–308

(56) References Cited

U.S. PATENT DOCUMENTS 5,082,033 * 1/1992 Weiss ..... 141/39
5,313,990 * 5/1994 Clusserath ..... 141/6

FOREIGN PATENT DOCUMENTS 9321223 10/1996 (DE) .
0601514 6/1994 (EP) .
2071629 9/1981 (GB) .

* cited by examiner

*Primary Examiner*—J. Casimer Jacyna
(74) *Attorney, Agent, or Firm*—Nils H. Ljungman & Associates

(57) ABSTRACT

In a mechanical single-chamber filling system for filling bottles or similar containers with a liquid product, each filling element has a return gas tube that forms a gas or return gas duct that emerges in a gas space of a toroidal bowl. In this gas or return gas duct there is a mechanically actuated pressurization gas valve. The pressurization gas valve is simultaneously realized in the form of a Trinox valve, namely to regulate a Trinox pressure in the respective container, largely independently of the pressure in a Trinox duct.

20 Claims, 5 Drawing Sheets

SINGLE-CHAMBER FILLING SYSTEM

BACKGROUND OF THE INVENTION

1. Field of the Invention

The present invention relates to a single-chamber filling system.

2. Background Information

The prior art discloses filling systems of this type in a wide variety of realizations.

OBJECT OF THE INVENTION

The object of the present invention is to describe a filling system that makes it possible, utilizing a simplified design and construction, to adjust a filling height by means of Trinox in a particularly reliable manner.

SUMMARY OF THE INVENTION

The present invention teaches that this object can be accomplished by means of a single-chamber filling system for filling bottles or similar containers with a liquid product, characterized by a Trinox duct that holds a gas, preferably an inert gas, at a second gas pressure which is greater than the first gas pressure, whereby the Trinox duct can be placed in communication via the control valve and a first gas pathway with the interior of the container that is fastened to the filling element, and whereby the pressurization gas valve can be realized in the form of a pressurization or tension gas and Trinox valve such that its valve body can open automatically when the gas pressure in the gas duct exceeds a specified pressure threshold which is higher than the first gas pressure but lower than the second gas pressure.

In the present invention, the pressurization gas valve or its valve body can simultaneously form the Trinox valve. The resulting configuration is simplified and particularly reliable.

In a preferred embodiment of the invention, in the first gas pathway, by means of which the interior of the container is pressurized with the Trinox pressure after the end of the filling and after the closing of the filling or fluid valve, to adjust the filling height and to push back excess product through the return gas tube into the fluid space or bowl, an element that reduces the gas flow, for example in the form of a throttle or nozzle, can be provided. As a result, in connection with the special realization of the pressurization gas valve, the Trinox pressure in the filled container (bottle) is largely independent of fluctuations of the gas pressure in the Trinox duct.

In other words and in accordance with at least one possible embodiment of the present invention, a first gas pathway can be used to pressurize the interior with Trinox pressure after the end of the filling and closing of the fluid valve. A nozzle, throttle or restrictor can be positioned in this first gas pathway to reduce the gas flow.

Refinements of the present invention are disclosed in the features and subclaims.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The present invention is explained in greater detail below with reference to the exemplary embodiments illustrated in the accompanying figures, in which.

DESCRIPTION OF THE PREFERRED EMBODIMENT

Figure 1:
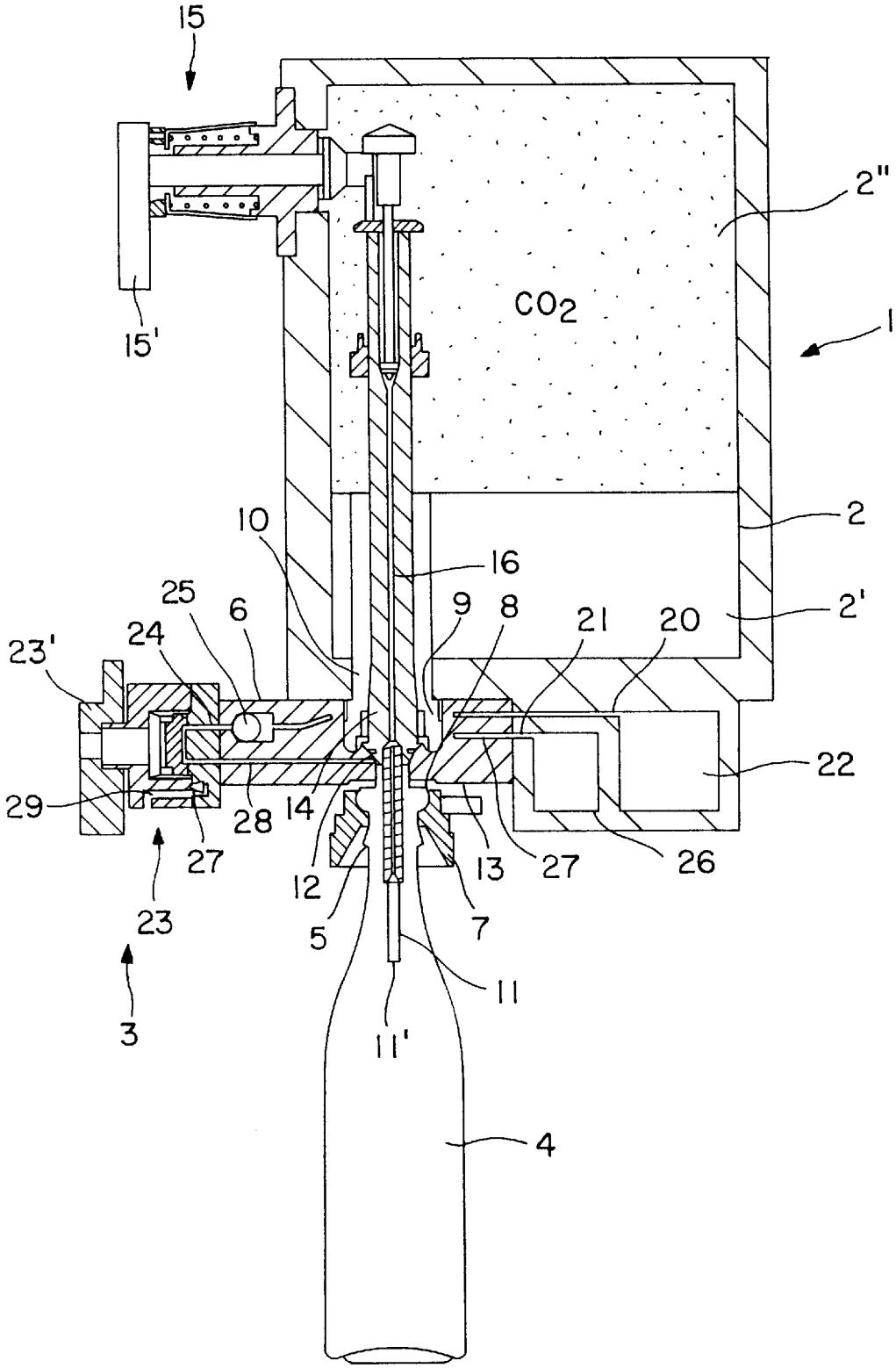
FIG. 1 is a simplified illustration in vertical section of one of the filling elements of a filling machine with a rotating construction in a first embodiment of the invention.
Figure 2:
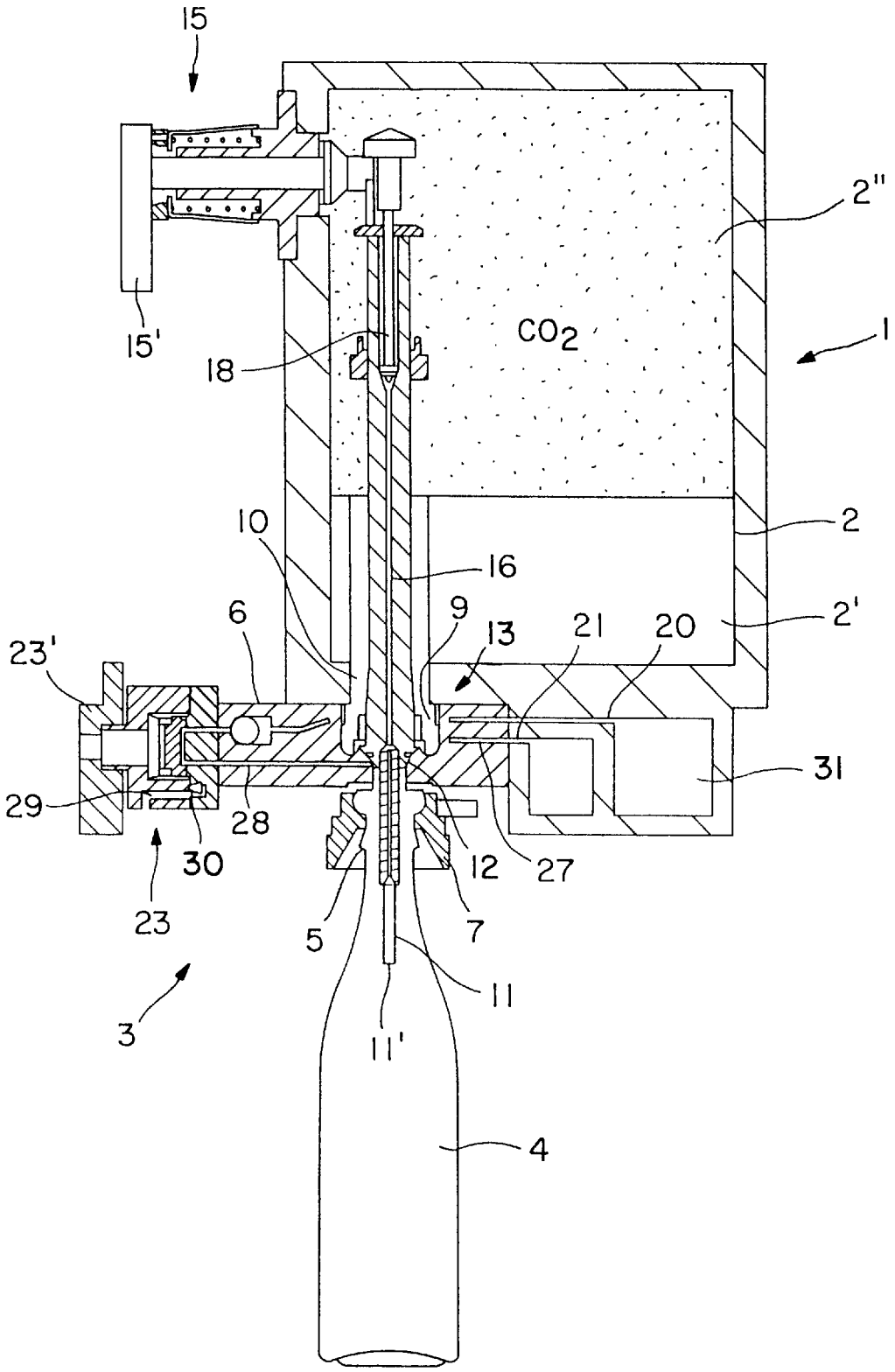
FIG. 2 is an illustration like FIG. 1, but with an additional possible embodiment of the invention.
Figure 3:
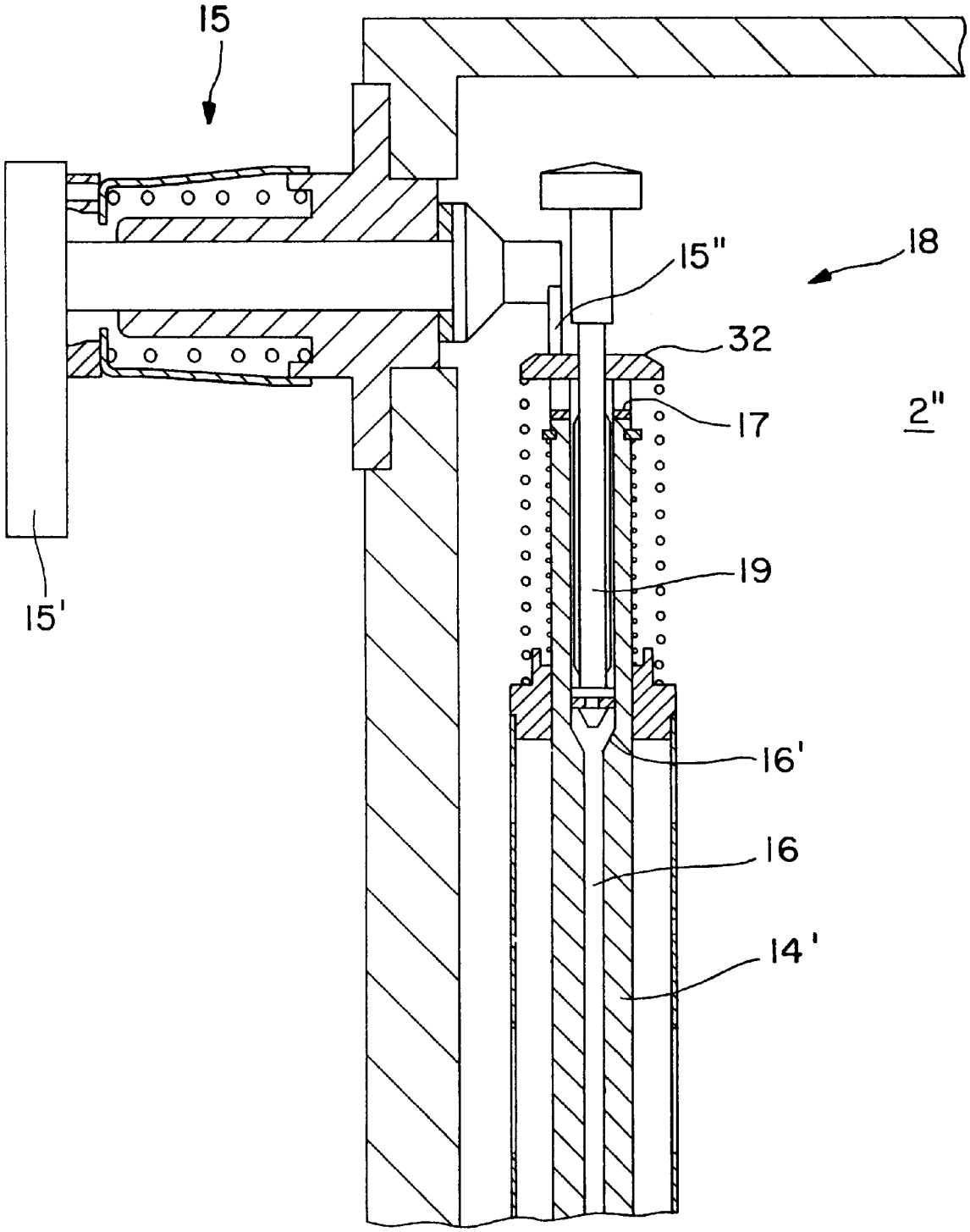
FIG. 3 is an enlarged detail of the pressurization gas and Trinox valve.

FIGS. 1–3 show a toroidal bowl or product bowl 1 of a mechanical single-chamber filling system, or of a mechanical single-chamber filling machine with a rotating construction. The toroidal bowl 1, as in known devices, is a component of the rotor of the filling machine, which rotor rotates around the vertical axis of the machine. During operation of the filling machine, the interior 2 of the product bowl 1 is filled up to a specified level N with the liquid product, so that in the toroidal bowl 1 and in the bowl interior 2 there is a liquid space 2' that is occupied by the liquid product and, above the level N, a gas space 2" which holds an inert gas, such as $CO_2$ gas at a specified filling pressure.

On the underside of the toroidal bowl 2, there are filling elements 3 that are distributed at equal angular intervals around the machine axis, which filling elements each form a filling site with a bottle carrier (not shown), to fill the bottles 4 which for this purpose are fastened with their bottle mouth 5 by the respective bottle carrier in a sealed position against the filling element 3 or against a gasket 8 formed in the vicinity of a centering device 7 on the underside of the housing 6 of the filling element 3.

In the housing 6 there is a liquid duct 9 that is in communication on top via a passage 10 with the liquid chamber 2' and on the underside of the housing 6 forms, for example, a substantially circular ring-shaped dispensing opening 12 for the liquid product that substantially concentrically surrounds a return gas tube 11. When the bottle 4 is in sealed contact with the filling element 3, the interior is therefore in externally sealed communication by means of the dispensing opening 12 with the lower end of the liquid duct 9. In the liquid duct 9, there is a valve body 14 that can form the filling or liquid valve 13, which is shown in FIG. 1 in its lower position in which it closes the fluid valve 13, and which to open the fluid valve 13 is moved upward in the direction of the valve axis VA, and to close the fluid valve 13 is moved downward again, and is controlled in a known manner by a mechanical control element 15, the pinion 15' of which interacts with the control cams (not shown) of a control cam that does not rotate with the rotor, and which acts via a control cam 15" on the shaft 14'.

In other words and in accordance with at least one embodiment of the present invention, the housing 6 can contain a liquid duct 9 that can be in fluid communication on top via a passage 10 with the liquid chamber 2'. On the underside of the housing 6, the duct 9 can form a circular ring-shaped dispensing opening 12 for the liquid product that concentrically surrounds a return gas tube 11. When the bottle 4 is in sealed contact with the filling element 3, the interior can therefore be in externally sealed communication by means of the dispensing opening 12 with the lower end of the liquid duct 9. In the liquid duct 9, there is a valve body 14 that can serve as the filling or liquid valve 13, which is shown in FIG. 1 in its lower position. In the lower position shown in FIG. 1, the valve body 14 can close the fluid valve 13. To open the fluid valve 13, the valve body 14 can be moved upward in the direction of the valve axis VA, and to close the fluid valve 13, can be moved downward again. The valve body 14 can be controlled in a known manner by a mechanical control element 15, the pinion 15' of which interacts with the control cams (not shown) of a control cam that does not rotate with the rotor, and which can act via a control cam 15" (see FIG. 3) on the shaft 14'.

The interior of the gas tube 11 which projects by a specified length beyond the underside of the filling element 3 and is open on the lower end 11', continues in a duct formed in the shaft 14' of the valve body 14, so that a gas duct 16 is formed that extends partly in the gas tube 11 and partly in the shaft 14', and reaches from the lower end 11' of the gas tube to inside the gas space 2", and in particular has a mouth 17 (see FIG. 3) in the gas space 2" that is significantly higher than the level N. In the vicinity of the mouth 17, in the gas duct 16 there is a pressurization, overpressurization or tension gas (German Spanngas) and Trinox valve 18, which in the illustrated embodiment is formed essentially by a valve stylus 19 that extends through the mouth 17 into the interior of the gas duct 16, and with its lower, free end interacts with a valve seat 16' formed inside the gas duct 16. The valve stylus 19 can be lifted in the direction of the axis VA and thus in the axial direction of the gas duct 16 out of the position closing the gas duct 16 to open the pressurization gas and Trinox valve 18, in which it is controlled by the mechanical control element 15. The valve stylus 19 is also biased by its dead weight, and is also assisted if necessary by a spring (not shown) into its position in which it closes the pressurization gas and Trinox valve 18, as explained in greater detail below.

In other words and in accordance with at least one embodiment of the present invention, the gas tube 11 can project by a specified length beyond the underside of the filling element 3. Additionally, the interior of the gas tube 11 can be open on the lower end 11' and can continue in a duct formed in the shaft 14' of the valve body 14, so that a gas duct 16 is formed that can extend partly in the gas tube 11 and partly in the shaft 14'. The gas duct 16 can reach from the lower end 11' of the gas tube to inside the gas space 2", and in particular can have a mouth 17 in the gas space 2" that is significantly higher than the level N. In the vicinity of the mouth 17, in the gas duct 16 there can be a pressurization or tension gas and Trinox valve 18, which in the illustrated embodiment can be formed essentially by a valve stylus 19 that extends through the mouth 17 into the interior of the gas duct 16, and with its lower, free end can interact with a valve seat 16' formed inside the gas duct 16. The valve stylus 19 can be lifted in the direction of the axis VA and thus in the axial direction of the gas duct 16 out of the position closing the gas duct 16 to open the pressurization gas and Trinox valve 18, in which it is controlled by the mechanical control element 15. The valve stylus 19 can also be biased by its dead weight, and can also be assisted if necessary by a spring (not shown) into its position in which it closes the pressurization gas and Trinox valve 18.

In at least one possible embodiment of the present invention, the Trinox duct can contain a gas, for example $CO_2$, at a pressure greater than (for example 1–2 bar greater than) the gas pressure in the toroidal or product bowl 1 of the the filling machine.

In the filling element 3 and thus partly in the housing 6, there can be, among other things, ducts 20 and 21, of which the duct 20 is connected by one end to a vacuum duct 22 that is provided on the underside of the toroidal bowl 1 and is common to all the filler elements 3, which vacuum duct, for its part, is connected with a source of vacuum or negative pressure (not shown). The other end of the duct 20 is connected to an input of a mechanical control valve device 23, which can be provided separately for each filler element 3 on its housing 6. In the illustrated embodiment, the control valve device 23 is formed by a rotary disc valve which can be controlled by means of a control lever 23' by a stationary control cam (not shown). In the duct 20, located in series, are a throttle or nozzle 24 and a valve 25. The valve 25 acts on one hand as a check valve, by opening only for a gas current in the direction of the vacuum duct 22, and by closing in the opposite direction. The valve 25 functions simultaneously as a pressure relief valve, which closes when the pressure in the duct 20, on the side of the valve 25 facing away from the vacuum duct 22, falls below a lower pressure threshold (relief pressure). The pressure threshold can be adjustable.

The duct 21 is connected with its one end with a Trinox duct 26 which is realized on the underside of the toroidal bowl 1 in the form of a toroidal duct that is common to all the filling elements 3. The other end of the duct 21 is in communication with a second input of the control valve 23. A second throttle 27 is also connected in the duct 21. The Trinox duct 26 contains an inert gas, for example $CO_2$ gas, in a known manner, at a gas pressure that is higher than the filling pressure in the gas space 2", i.e. in the Trinox duct 26, a pressure is set, for example, that is 1.0–2.0 bar higher than the filling pressure in the gas space 2".

There is also a third duct 28 that is in communication downstream of the fluid valve 13 on its one end with the fluid duct 9 in the direction of flow, and on its other end is connected to a third connection of the control valve 23. In the control valve 23 there is also a depressurization duct 29 that leads to the atmosphere.

The control valve 23 has, for example, at least four switching positions, namely a first switching position in which all the ducts 20, 21 and 28 are connected to the control valve 23, a second switching position in which the duct 20 is connected with the duct 28 and the duct 21 is closed, as well as a third switching position in which the duct 20 on the control valve 23 is closed and the duct 21 is connected with the duct 28. In a fourth switching position of the control valve, the ducts 20 and 21 are closed, although the duct 28 is connected by means of the control valve with the duct 29.

FIG. 2 shows, as an additional embodiment, a filling system that differs from the filling system illustrated in FIG. 1 essentially only in that instead of the vacuum duct, there is a return gas duct 31, which is in turn realized on the underside of the toroidal bowl 1 in the form of a toroidal duct that is common to all of the filling elements 3. The embodiment illustrated in FIG. 2 also omits the valve 25 in the duct 20.

With the system illustrated in FIG. 1, a filling process is possible that includes the following process steps, for example:

Evacuate bottle 4

With the filling valve 13 closed, the interior of the bottle 4 that is in sealed contact with the filling element 3 is evacuated to approximately 90% vacuum by connecting the duct 28 with the duct 20 via the control valve 23.

Flush bottle 4 with $CO_2$

With the filling valve 13 closed, and with the control valve 23 blocking the ducts 20, 21 and 28, the pressurization gas and Trinox valve 18 is opened mechanically, and is controlled by means of the pinion 15'. The result of this process is to introduce $CO_2$ from the gas space 2" via the gas duct 16 into the bottle 4.

Repeated evacuation of the bottle 4

With the filling valve 13 closed and the pressurization gas and Trinox valve 18 closed, the duct 28 is once again placed in communication with the duct 20 by means of the control valve 23, as a result of which the bottle is once again evacuated to approximately 90% vacuum.

Pre-pressurization of the bottle 4

With the filling valve 13 closed, and through the ducts 20, 21 and 28 closed by the control valve 23, there is a repeated mechanical opening of the pressurization gas and Trinox valve 18, which is controlled by means of the pinion 15', whereby the interior of the bottle 4 is pre-pressurized to the filling pressure.

In other words and in accordance with at least one embodiment of the present invention, with the filling valve 13 closed and the valve 23 closed the pressurization gas and Trinox valve 18 can be mechanically opened to pre-pressurize the interior of the bottle 4. The pressurization gas and Trinox valve 18 can be controlled by the pinion 15'. By closing the control valve 23, the ducts 20, 21, 28 can be closed off to allow the bottle 4 to be pre-pressurized.

Filling of the bottle 4

As soon as the pressure between the interior of the bottle 4 and the toroidal bowl or the gas space 2" in the toroidal bowl 1 has equalized, the fluid valve 13 can open automatically as a result of the spring bias of the valve body 14. The pressurization gas and Trinox valve 18 can also be opened mechanically. The ducts 20, 21 and 28 are blocked by the control valve 23.

Completion of filling

As soon as the level of product in the bottle 4 exceeds the lower end 11' of the return gas tube 11, the discharge of the gas displaced by the product from the interior of the bottle 4 via the gas duct 16 into the gas space 2" is interrupted. The further flow of the product out of the liquid space 2' is thereby prevented or substantially prevented. The pressurization gas and Trinox valve 18 is still in the open position. The ducts 20, 21 and 28 are blocked at the control valve 23.

Filling valve mechanically closed and Trinox valve opened

The filling valve 13 is mechanically closed. As described above, in the Trinox duct 26 a pressure is set which is approximately 1.0–2.0 bar higher than the filling pressure in the gas space 2".

The pressurization gas and Trinox valve 18 is now in its open position as a result of the pressure in the duct 16. The ducts 21 and 28 are connected via the control valve 23, so that a gas current restricted by the nozzle 27 can flow out of the Trinox duct 26 into the bottle 4 or into the bottle neck or mouth 5. In the bottle 4, above the level of product that has accumulated there, an overpressure builds up that results from the filling pressure in the toroidal bowl 1, from the weight or closing force of the valve stylus 19 (pressure threshold of the pressurization gas and Trinox valve 18) and from the gas current flowing through the nozzle 27. This Trinox pressure in the bottle 4 is set by an appropriate sizing of the cross section of the nozzle 27 and of the closing force of the valve stylus 19 so that the product in the bottle 4 above the end 11' is pushed back via the gas duct 16, smoothly and without significant agitation, in particular without significant foaming and splattering, into the interior 2 of the toroidal bowl 1. On account of the gas flow restricted via the nozzle 27, a constant and reproducible gas gap is formed between the end 11' and the level of the product in the bottle 4. As a result, the degree of accuracy in the filling height that can be achieved is far beyond that of known filling systems.

If, as described above, the Trinox duct 26 is supplied with $Co_2$, the gas current flowing via the gas duct 16 to the interior 2 continuously enriches the atmosphere in the gas space 2" with $CO_2$.

Controlled preliminary depressurization

With the filling valve 13 closed, with the pressurization gas and Trinox valve 18 closed, and with the ducts 20 and 28 connected via the control valve 23, there is a controlled preliminary depressurization. For this purpose, the preliminary depressurization pressure desired in the bottle neck is set at the valve 25 (by the selection of the appropriate spring force). The gases that escape from the bottle 4 during the preliminary depressurization are discharged via the vacuum duct 22. The pressure reduction from the filling pressure to the preliminary depressurization pressure is smooth, and is accomplished by throttling the gas current via the nozzle or throttle 24.

The gas expanding in the gas duct 16 can flow out via the above mentioned gas gap between the end 11' and the level of the product in the bottle 4 without significant agitation of the surface of the product, through the bottle neck and the ducts 28 and 20. Thus there is no agitation or no significant agitation of the product in the bottle 4 caused by this gas expanding in the gas duct 16, which is in marked contrast to similar filling systems of the prior art, in which, at the end of the filling process, the end 11' of the gas tube 11 is immersed in the product. Depending on the product being dispensed, the preliminary depressurization pressure is set so that gas bubbles from the beverage ascend to the surface quickly and without any substantial foaming that might interfere with the filling process.

Final depressurization to atmospheric pressure

With the filling valve 13 closed and the pressurization gas and Trinox valve 18 closed, the duct 28 is connected with the duct 29 via the control valve 23. The ducts 20 and 21 are closed at the control valve 23. The final depressurization to atmospheric pressure then takes place by means of a nozzle 30 provided in the duct 29. As a result of the preceding preliminary depressurization, there are no notable splattering losses during this final depressurization.

With certain types of products, with beer for example, the preliminary depressurization pressure at the valve 25 can be set so that it is only slightly higher than atmospheric pressure (e.g. approximately 0.5 bar). In that case, the final depressurization step can be omitted.

An additional modification to the process described above is that, for example, the bottle 4 is evacuated only once, i.e. the first evacuation and the intermediate rinsing of the bottle are omitted.

The filling process (single-chamber filling principle with or without preliminary depressurization, with the controlled preliminary depressurization into the vacuum duct 22, with level correction by Trinox and final depressurization into the atmosphere) that is possible with the embodiment illustrated in FIG. 1 and is described above is suitable in particular for the bottling of wine, cooler beverages, sparkling wines and champagnes, as well as carbonated alcoholic mixed drinks.

In the embodiment with double pre-evacuation (low-oxygen bottling), the system is suitable primarily for the bottling of bottom-fermented and top-fermented beers up to 6.0 gr $CO_2$/liter, of wheat beers up to 9.0 gr/$CO_2$/liter and oxygen-sensitive soft drinks.

With the system illustrated in FIG. 2, for example, a process can be carried out that differs from the process described above in that the process steps "Evacuate bottle 4" and "Flush bottle 4 with $CO_2$" can be omitted. With the process that can be performed using the system illustrated in FIG. 2, the process step described below can also be inserted before the process step "Pre-pressurization of the bottle 4": Partial pressurization of the bottle 4 from the preliminary depressurization duct 31

With the filling valve 13 closed and with the ducts 20 and 28 in communication with one another via the control valve 23, before the final pressurization of the bottle 4 from the gas space 2", there is a partial pressurization from the return gas or preliminary depressurization duct 31, which contains a specified or adjustable $CO_2$ pressure, which can be about one-half the filling pressure, for example. As a result of this partial pressurization, an atmosphere with a high $CO_2$ concentration is achieved in the respective bottle 4. This $CO_2$ atmosphere is improved if $CO_2$ is also used in the subsequent Trinox step, as a result of which the concentration of $CO_2$ in the atmosphere in the gas space 2" and thus ultimately the concentration of $CO_2$ in the preliminary depressurization duct 31 are improved.

As a result of the partial pressurization to an intermediate pressure level, an excessive atomization of liquid particles during the subsequent pressurization from the toroidal bowl is substantially prevented. Under some conditions, these atomized particles form detachment nuclei of the $CO_2$ dissolved in the product, which could lead to an uncontrolled foaming during the subsequent depressurization.

The process steps pressurization of the bottle from the gas space 2", filling, end of filling, mechanical closing of the filling valve and opening of the Trinox valve, are substantially the same as in the process described above.

In the process that uses the system illustrated in FIG. 2, the controlled depressurization does not take place via the valve 25 into the vacuum duct, but via the nozzle 24 provided in the duct 20 into the return gas or preliminary depressurization duct 31 in which, as described above, the specified preliminary depressurization pressure is set or adjusted, and namely with the filling valve 13 closed and with the ducts 28 and 20 in communication with one another via the control valve 23. During this controlled preliminary depressurization, the preliminary depressurization pressure and the pressure change are also substantially optimally adjusted for the product being bottled (by an appropriate sizing of the nozzle 24), so that there are no problems caused by the product (foaming, release of $CO_2$, etc.).

FIG. 3 shows once again in an enlarged detail an embodiment of the upper end of the shaft 14' and the pressurization gas and Trinox valve 18 formed there with the valve stylus 19. As illustrated, the valve stylus 19 is free-floating in the disc 32 provided on the upper end of the shaft 14', i.e. it can be moved in the direction of the vertical axis VA. The disc 32 is used in the manner of the prior art, in interaction with the control element 15 and its control cam 15", to close the fluid valve 13. When the fluid valve 13 is closed, the valve stylus 19 can thus be lifted by the pressure in the interior of the bottle 4 connected to the filling element 3, as a result of which the lower end of the valve stylus 19 exposes the valve seat 16' formed in the gas duct 16 and thus opens the pressurization gas and Trinox valve 18. The pressure or pressure threshold thereby required for the opening results from the weight of the valve stylus 19. This opening pressure can also be increased or adjusted by a spring (not shown), if necessary.

The special feature is therefore the dual function of the valve stylus 19 both as a pressurization gas valve stylus and also as a Trinox valve stylus.

During the flushing and/or pre-pressurization from the gas space 2", the stylus 19 is mechanically lifted by the control element 15 or by the control cam 15" formed on it to open the pressurization gas and Trinox valve 18.

With the configuration of the pressurization gas and Trinox valve 18 described above, in connection with the nozzle 27 provided in the duct 21, there is also a regulation of the Trinox pressure in the neck of the bottle 4 attached to the filling element 3, and in particular in such a way that pressure fluctuations in the Trinox duct 26 have hardly any influence on the Trinox pressure in the bottle neck, i.e. the pressure in the bottle 4, following the opening of the Trinox duct in the manner described above, is essentially a function of the closing force or the pressure threshold of the pressurization gas and Trinox valve 18, and of the sizing of the nozzle 27 and the gas current flowing via the nozzle 27 into the bottle neck. The nozzle 27 and the closing force of the pressurization gas or Trinox valve 18, i.e. the weight of the closing stylus 19, are set so that the Trinox pressure formed in the bottle is just sufficient to smoothly push back excess product into the interior 2.

As a result of the preliminary depressurization and the final depressurization, if any, into the vacuum duct 22, microbiological problems that can result during a depressurization into the atmosphere in the immediate vicinity of the respective filling element 3 from atomized product can also substantially be prevented. In particular also during the bottling of beer, the pressure of the preliminary depressurization into the vacuum duct 22 can be set sufficiently low that a subsequent final depressurization is no longer necessary.

Figure 4:
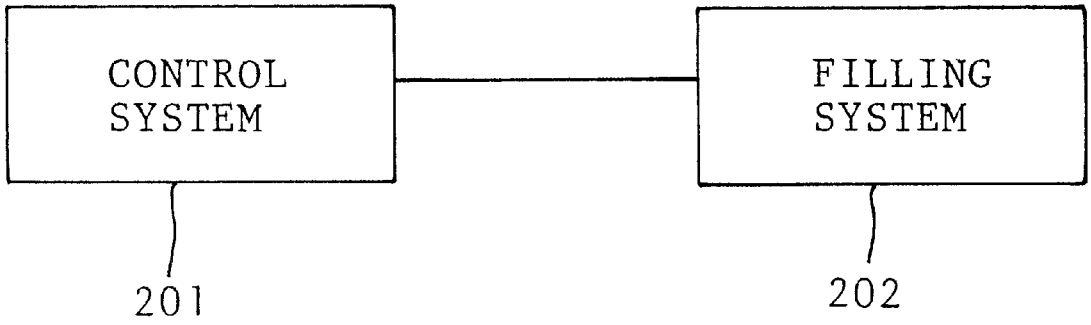
FIG. 4 illustrates in block form a filling device with a control system.

FIG. 4 shows a block diagram indicating a control system 201 connected to the filling system 202. The control system 201 can contain all of the components necessary for control of the system, including for example, computers, sensors, and components to manipulate the filling system 202.

Figure 5:
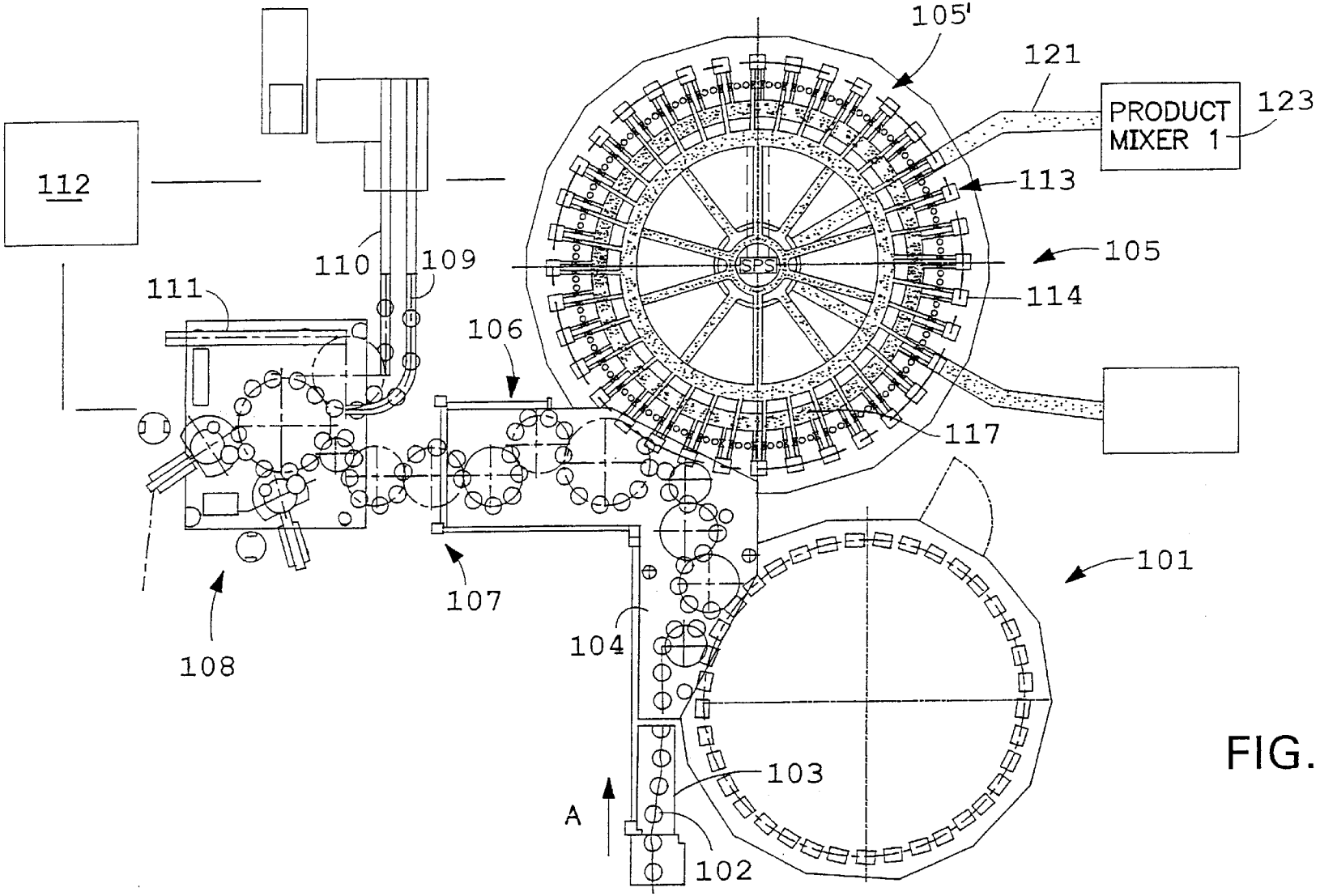
FIG. 5 shows a simplified overhead view of a system for the simultaneous filling, closing and subsequent labelling of containers, namely bottles, with which the present invention may be utilized.

FIG. 5 shows one example of a system for filling containers which could possibly utilize the present invention. FIG. 5 shows a rinser 101, to which the containers, namely bottles 102, are fed in the direction indicated by the arrow A by means of a conveyor line 103, and downstream of which, in the direction of travel, the rinsed bottles 102 are transported by means of a conveyor line 104 formed by a star wheel conveyor to a filling machine 105 or its inlet star wheel. Downstream of the filling machine 105, in the direction of travel of the bottles 102, there can preferably be a closer 106 which closes the bottles 102. The closer 106 can be connected directly to a labelling device 108 by means of a conveyor line 107 formed by a plurality of star wheel conveyors. In the illustrated embodiment, the labelling machine has three outputs, namely one output formed by a conveyor 109 for bottles 102 which are filled with a first product, and are then labelled corresponding to this product, a second output formed by a conveyor 110 for those bottles 102 which are filled with a second product and are then labelled corresponding to this product, and a third output formed by a conveyor 111 which removes any bottles 102 which have been incorrectly labelled.

In FIG. 5, 112 is a central electronic control device which includes a process controller which, among other things, controls the operation of the above-referenced system.

The filling machine 105 is preferably of the revolving design, with a rotor 105' which revolves around a vertical machine axis. On the periphery of the rotor 105' there are a number of filling positions 113, each of which consists of bottle carriers or container carriers, as well as a filling element 114 located above the respective container carrier. The toroidal vessel 117 is a component of the revolving rotor 105'. The toroidal vessel 117 can be connected by means of a rotary coupling and by means of an external connecting line 121 to an external reservoir or mixer 123 to supply the product.

As well as the more typical filling machines having one toroidal vessel, it is possible that in at least one possible embodiment of the present invention a filling machine could possibly be utilized wherein each filling element 114 is preferably connected by means of two connections to a toroidal vessel 117 which contains a first product (by means of a first connection) and to a second toroidal vessel which contains a second product (by means of the second connection). In this case, each filling element 114 can also preferably have, at the connections, two individually-controllable fluid or control valves, so that in each bottle 102 which is delivered at the inlet of the filling machine 105 to a filling position 113, the first product or the second product can be filled by means of an appropriate control of the filling product or fluid valves.

One feature of the invention resides broadly in the single-chamber filling system for filling bottles or similar containers 4 with a liquid product, with at least one filling element 3, in the housing 6 of which a fluid duct 9 is formed that forms a dispensing opening and is in communication with a fluid space occupied by the product in a bowl 2 that contains, above the product, a gas space 2" with an atmosphere under a first gas pressure (filling pressure), with a fluid valve 13 which opens in a filling phase to fill the respective container 4 placed with a container mouth 5 on the filling element 3 and closes again at the end of the filling phase, with a back-gas tube 14 which projects with its lower, open end 11' beyond the underside of the filling element 3 and is surrounded at least partly by the dispensing opening 12 of the fluid duct 9, with a gas duct 16 that extends from the lower end 11' of the back-gas tube 11 into the gas space 2", with a controlled pressurization gas [German Spanngas] valve 18 provided on this gas duct, which pressurization gas valve 18 has a valve body 19 which in a closed position blocks the gas duct from the gas space 2 and in an open position opens the gas duct 16 to the gas space 2", and with gas pathways 20, 21, 28 realized at least partly in the housing 6 of the filling element 3, which gas pathways can be controlled by means of a control valve 23, characterized by a Trinox duct 26 that holds a gas, preferably an inert gas, at a second gas pressure which is greater than the first gas pressure, whereby the Trinox duct 26 can be placed in communication via the control valve 23 and a first gas pathway 21, 28 with the interior of the container 44 that is fastened to the filling element 3, and whereby the pressurization gas valve is realized in the form of a pressurization gas and Trinox valve 18 such that its valve body 19 opens automatically when the gas pressure in the gas duct 16 exceeds a specified pressure threshold which is higher than the first gas pressure but lower than the second gas pressure.

Another feature of the invention resides broadly in the filling system characterized by the fact that the first gas pathway 21, 28 emerges in an area of the fluid duct 9 that lies underneath the fluid valve 13 in the direction of flow of the product.

Yet another feature of the invention resides broadly in the filling system characterized by the fact that in the first gas pathway 20, 28 there is at least one element that reduces the pressure, for example at least one nozzle or throttle 27.

Still another feature of the invention resides broadly in the filling system characterized by the fact that the pressurization gas and Trinox valve 18 or its valve body 19 can be actuated by a mechanical control element 15, which interacts, for example, with a stationary control curve or stationary control cams.

A further feature of the invention resides broadly in the filling system characterized by the realization in the form of a filling machine of the revolving or rotating type with a plurality of filler elements 3 provided on a rotor or toroidal bowl 1.

Another feature of the invention resides broadly in the filling system characterized by the fact that the control valve 23 is a mechanically actuated valve which interacts, for example, with a stationary control cam or with stationary control cams.

Yet another feature of the invention resides broadly in the filling system characterized by the fact that the valve body of the pressurization gas and Trinox valve 18 is a valve stylus 19 that can be displaced axially in the gas duct 16, which valve stylus interacts with a valve seat 16' formed in the gas duct 16.

Still another feature of the invention resides broadly in the filling system characterized by the fact that the pressure threshold is determined or set by the dead weight of the valve body 19.

A further feature of the invention resides broadly in the filling system characterized by the fact that the pressure threshold is at least partly determined by spring means that bias the valve body 19 in its closed position.

Another feature of the invention resides broadly in the filling system characterized by at least one second gas pathway 21, by means of which, in a second position of the control valve 23, the interior of the container 4 fastened to the filling element 3 can be placed in communication via the container mouth 5 with an additional duct 22, 31.

Yet another feature of the invention resides broadly in the filling system characterized by the fact that in the second gas pathway 20, there is at least one second throttle or nozzle 24.

Still another feature of the invention resides broadly in the filling system characterized by the fact that in the second gas pathway 20 there is a pressure regulating valve 25 which blocks the second gas pathway 20 when the pressure drops below a second pressure threshold (e.g. preliminary depressurization pressure).

A further feature of the invention resides broadly in the filling system characterized by the fact that the additional duct 22 is a vacuum duct that is connected or can be connected to a source of vacuum or negative pressure.

Another feature of the invention resides broadly in the filling system characterized by the fact that the at least one additional duct 31 is a back-gas or preliminary depressurization duct, and is designed in particular to receive the gas displaced from the container 4 during the filling of the container 4 at a specified third gas pressure that is lower than the first gas pressure.

U.S. Pat. No. 4,135,699, issued Jan. 23, 1979 to Petzsch et al., which may contain valves or valve components which may be used in embodiments of the present invention, is hereby incorporated by reference as if set forth in its entirety herein.

Examples of container filling machines and components thereof which may be used in accordance with embodiments of the present invention, may be found in the following U.S. Pat. Nos. 5,413,153, issued May 9, 1995; No. 5,558,138, issued Sep. 24, 1996; and No. 5,713,403, issued Feb. 3, 1998.

Possible examples of the interconnection between the components of the bottling system and of the design of the setup table 1, the star wheels 2,3 the guide tracks 4, the support plate 6 the columns 8 and the vertical segments 9, may be found in U.S. patent application Ser. No. 09/151,845, filed on Sep. 11, 1998, which has the inventors Ulrich Petri and Klaus-Werner Jung, and which is assigned to KHS Maschinen-und Anlagenbau Aktiengesellschaft, which U.S. Patent Application is hereby incorporated by reference as if set forth in its entirety herein.

Examples of bottling systems, which may be used in or with embodiments of the present invention, may be found in the following U.S. Patents, which are hereby incorporated by reference, as if set forth in their entirety herein: U.S. Pat. No. 5,634,500, issued on Jun. 3, 1997 and entitled "Method for Bottling a Liquid in Bottles or Similar Containers"; No. 5,558,138, issued Sep. 24, 1996 and entitled "Process and Apparatus for Cleaning Container Handling Machines Such as Beverage Can Filling Machines"; and U.S. Pat. No. 5,713,403, issued Feb. 3, 1998 and entitled "Method and System for Filling Containers with a Liquid Filling Product, and Filling Machine and Labelling Device for Use with this Method or System". All of the above U.S. patent documents in this paragraph are assigned to KHS Maschinen- und Anlagenbau Aktiengesellschaft of the Federal Republic of Germany.

Examples of container labelling and/or filling machines and components thereof and/or accesories therefor which may be used in embodiments of the present invention, may be found in the following documents, which are hereby incorporated by reference, as if set forth in their entirety herein: U.S. Pat. No. 4,944,830 issued on Jul. 31, 1990 and entitled "Machine for Labelling Bottles"; U.S. Pat. No. 4,911,285 issued on Mar. 27, 1990 and entitled "Drive for a Rotary Plate in a Labelling Machine for Bottles"; U.S. Pat. No. 4,976,803 issued on Dec. 11, 1990 and entitled "Apparatus for Pressing Foil on Containers, Such As on the Tops & the Necks of Bottles or the Like; U.S. Pat. No. 4,950,350 issued on Aug. 21, 1990 and entitled "Machine for Labelling Bottles or the Like"; U.S. Pat. No. 5,017,261 issued on May 21, 1991 and entitled "Labelling Machine for Objects Such as Bottles or the Like"; U.S. Pat. No. 5,062,917 issued on Nov. 5, 1991 and entitled "Support Element for the Followers of a Cam Drive of a Drive Mechanism & a Labelling Station Equipped With a Support Element"; U.S. Pat. No. 4,981,547 issued on Jan. 1, 1991 and entitled "Mounting & Drive Coupling for the Extracting Element Support of a Labelling Station for a Labelling Machine for Containers and Similar Objects"; U.S. Pat. No. 5,004,518 issued on Apr. 2, 1991 and entitled "Labelling Machine for Objects such as Bottles or the Like"; U.S. Pat. No. 5,078,826 issued on Jan. 7, 1992 and entitled "Labelling Machine for the Labelling of Containers"; U.S. Pat. No. 5,062,918 issued on Nov. 5, 1991 and entitled "Glue Segments which can be Attachable to a Drive Shaft of a Labelling Machine"; U.S. Pat. No. 5,227,005 and issued on Jul. 13, 1993 and entitled "Labelling Station for Labelling Objects, Such as Bottles"; U.S. Pat. No. 5,087,317 issued on Feb. 11, 1992 and entitled "Labelling Machines for the Labelling of Container"; U.S. Pat. No. 5,129,984 issued on Jul. 14, 1992 and entitled "Bottle Labelling Machine"; U.S. Pat. No. 5,185,053 issued on Feb. 9, 1993 and entitled "Brushing Station for a Labelling Machine for Labelling Bottles & the Like"; U.S. Pat. No. 5,075,123 issued on Dec. 24, 1991 and entitled "Process & Apparatus for Removing Alcohol From Beverages"; U.S. Pat. No. 5,217,538 issued on Jun. 8, 1993 and entitled "Apparatus & Related Method for the Removal of Labels & Foil Tags Adhering to Containers, in Particular, to Bottles"; U.S. Pat. No. 5,174,851 issued on Dec. 29, 1992 and entitled "Labelling Machine for Labelling Containers, Such as Bottles"; U.S. Pat. No. 5,110,402 issued on May 5, 1992 and entitled "Labelling Machine for Labelling Containers Such as Bottles Having a Labelling Box for a Stack of Labels in a Labelling Station"; U.S. Pat. No. 5,167,755 issued on Dec. 1, 1992 and entitled "Adhesive Scraper Which Can be Adjusted in Relation to an Adhesive Roller in a Labelling Machine"; U.S. Pat. No. 5,413,153 issued on May 9, 1995 and entitled "A Container Filling Machine for Filling Open-Top Containers, & A Filler Valve Therefor"; U.S. Pat. No. 5,569,353, issued on Oct. 29, 1996 and entitled "Labelling Machine & Apparatus for the Automatic Loading of the Main Magazine of a Labelling Machine, & A Supply Magazine Which Can Be Used in Such an Apparatus". All of the above U.S. patent documents in this paragraph are assigned to KHS Maschinen- und Anlagenbau Aktiengesellschaft of the Federal Republic of Germany.

Some additional examples of container filling systems, valves or methods and their components which may be incorporated in an embodiment of the present invention may be found in U.S. Pat. No. 5,425,402, issued on Jun. 20, 1995 and entitled "Bottling System with Mass Filling and Capping Arrays"; U.S. Pat. No. 5,450,882, issued on Sep. 19, 1995 and entitled "Beverage Dispensing Apparatus and Process"; U.S. Pat. No. 5,377,726, issued on Jan. 3, 1995 and entitled "Arrangement for Filling Bottles or Similar Containers"; U.S. Pat. No. 5,402,833, issued on Apr. 4, 1995 and entitled "Apparatus for Filling Bottles or Similar Containers"; and U.S. Pat. No. 5,445,194, issued on Aug. 29, 1995 and entitled "Filling Element for Filling Machines for Dispensing a Liquid Filling Material into Containers."

Some additional examples of methods and apparatuses for closing bottles and containers and their components which may be incorporated in an embodiment of the present invention may be found in U.S. Pat. No. 5,402,623, issued on Apr. 4, 1995, and entitled "Method and Apparatus for Closing Bottles"; U.S. Pat. No. 5,473,855, issued on Dec. 12, 1995 and entitled "System for Installing Closures on Containers"; U.S. Pat. No. 5,447,246, issued on Sep. 5, 1995 and entitled "Methods and Combinations for Sealing Corked Bottles"; U.S. Pat. No. 5,425,402, issued on Jun. 20, 1995 and entitled "Bottling System with Mass Filling and Capping Arrays"; U.S. Pat. No. 5,398,485, issued on Mar. 21, 1995, and entitled "Bottle Support Mechanism for a Capping Machine"; U.S. Pat. No. 5,419,094, issued on May 30, 1995 and entitled "Constant Speed Spindles for Rotary Capping Machine"; and U.S. Pat. No. 5,449,080, issued on Sep. 12, 1995 and entitled "Methods and Combinations for Sealing Corked Bottles."

U.S. patent application Ser. No. 09/300,015, filed on or about Apr. 26, 1999, having the inventor Ludwig Cltsserath, with attorney docket no. NHL-HOL-41, and claiming priority from Federal Republic of Germany Patent Application No. 198 18 762.9, which Federal Republi of Germany Patent Application was filed on Apr. 27, 1998, and DE-OS 198 18 762.9 and DE-PS 198 18 762.9, are hereby incorporated by reference as if set forth in their entirety herein.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 198 18 761.0, filed on Apr. 27, 1998, having inventor Ludwig Cltsserath, and DE-OS 198 18 761.0 and DE-PS 198 18 761.0, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

PARTIAL NOMENCLATURE

1 Toroidal bowl
2 Bowl interior
2' Liquid space
2" Gas space
3 Filling element
4 Bottle
5 Mouth of bottle
6 Housing
7 Centering element
8 Gasket
9 Liquid duct
10 Passage
11 Return gas tube
11' End
12 Dispensing opening
13 Filling or fluid valve
14 Valve body
14' Valve body
15 Control element
15' Pinion
15" Control cam
16 Gas duct
16' Valve seat
17 Mouth
18 Pressurization gas and Trinox valve
19 Valve stylus
20, 21 Duct
22 Vacuum duct
23 Control valve
24 Throttle
25 Check and pressure control valve
26 Trinox duct
27 Throttle
28, 29 Duct
30 Throttle
31 Return gas or preliminary depressurization duct
32 Disc

What is claimed is:

1. Single-chamber filling system for filling bottles or similar containers with a liquid product, with at least one filling element, in the housing of which a fluid duct is formed that forms a dispensing opening and is in communication with a fluid space occupied by the product in a bowl that contains, above the product, a gas space with an atmosphere under a first gas pressure, with a fluid valve which opens in a filling phase to fill the respective container placed with a container mouth on the filling element and closes again at the end of the filling phase, with a back-gas tube which projects with its lower, open end beyond the underside of the filling element and is surrounded at least partly by the dispensing opening of the fluid duct, with a first gas duct that extends from the lower end of the back-gas tube into the gas space, with a controlled pressurization gas valve provided on this first gas duct, which pressurization gas valve has a valve body which in a closed position blocks the first gas duct from the gas space and in an open position opens the first gas duct to the gas space, and with gas pathways realized at least partly in the housing of the filling element, which gas pathways can be controlled by means of a control valve, comprising a second gas duct that holds a gas at a second gas pressure which is greater than the first gas pressure, wherein the second gas duct can be placed in communication via the control valve and a first gas pathway with the interior of the container that is fastened to the filling element, and wherein the pressurization gas valve is realized such that its valve body opens automatically when the gas pressure in the first gas duct exceeds a specified pressure threshold which is higher than the first gas pressure but lower than the second gas pressure.

2. Filling system according to claim 1, wherein the first gas pathway emerges in an area of the fluid duct that lies underneath the fluid valve in the direction of flow of the product.

3. Filling system according to claim 2, wherein in the first gas pathway there is at least one element that reduces the pressure, for example at least one nozzle or throttle.

4. Filling system according to claim 3, wherein the pressurization gas valve or its valve body can be actuated by a mechanical control element, which interacts, for example, with a stationary control curve or stationary control cams.

5. Filling system according to claim 4, wherein a filling machine of the revolving type comprises a plurality of filler elements provided on a rotor or toroidal bowl.

6. Filling system according to claim 5, wherein the control valve is a mechanically actuated valve which interacts, for example, with a stationary control cam or with stationary control cams.

7. Filling system according to claim 6, wherein the valve body of the pressurization gas is a valve stylus that can be displaced axially in the first gas duct, which valve stylus interacts with a valve seat formed in the first gas duct.

8. Filling system according to claim 7, wherein the pressure threshold is determined or set by the dead weight of the valve body.

9. Filling system according to claim 8, wherein the pressure threshold is at least partly determined by spring means that bias the valve body in its closed position.

10. Filling system according to claim 9, further comprising at least one second gas pathway, by means of which, in a second position of the control valve, the interior of the container fastened to the filling element can be placed in communication via the container mouth with an additional duct.

11. Filling system according to claim 10, wherein in the second gas pathway, there is at least one second throttle or nozzle.

12. Filling system according to claim 11, wherein in the second gas pathway there is a pressure regulating valve which blocks the second gas pathway when the pressure drops below a second pressure threshold comprising a preliminary depressurization pressure.

13. Filling system according to claim 12, wherein the additional duct is a vacuum duct that is connected or can be connected to a source of vacuum or negative pressure.

14. Filling system according to claim 13, wherein the at least one additional duct is a back-gas or preliminary depressurization duct, and is designed in particular to receive the gas displaced from the container during the filling of the container at a specified third gas pressure that is lower than the first gas pressure, and said gas comprising an inert gas.

15. Filling system according to claim 14, wherein said inert gas comprises carbon dioxide.

16. Single-chamber filling system for filling bottles or similar containers with a liquid product, with at least one filling element, in the housing of which a fluid duct is formed that forms a dispensing opening and is in communication with a fluid space occupied by the product in a bowl that contains, above the product, a gas space with an atmosphere under a first gas pressure, with a fluid valve which opens in a filling phase to fill the respective container placed with a container mouth on the filling element and closes again at the end of the filling phase, with a back-gas tube which projects with its lower, open end beyond the underside of the filling element and is surrounded at least partly by the dispensing opening of the fluid duct, with a first gas duct that extends from the lower end of the back-gas tube into the gas space, with a controlled pressurization gas valve provided on this first gas duct, which pressurization gas valve has a valve body which in a closed position blocks the first gas duct from the gas space and in an open position opens the first gas duct to the gas space, and with gas pathways realized at least partly in the housing of the filling element, which gas pathways can be controlled by means of a control valve, comprising a second gas duct that holds an inert gas at a second gas comprising a second gas duct that holds a gas at a second gas pressure which is greater than the first gas pressure, wherein the second gas duct can be placed in communication via the control valve and a first gas pathway with the interior of the container that is fastened to the filling element, and wherein the pressurization gas valve is realized such that its valve body opens automatically when the gas pressure in the first gas duct exceeds a specified pressure threshold which is higher than the first gas pressure but lower than the second gas pressure.

17. The filling system according to claim 16, wherein said inert gas comprises carbon dioxide.

18. A method of filling a bottle or a similar container using a single-chamber filling system for filling bottles or similar containers with a liquid product, with at least one filling element, in the housing of which a fluid duct is formed that forms a dispensing opening and is in communication with a fluid space occupied by the product in a bowl that contains, above the product, a gas space with an atmosphere under a first gas pressure, with a fluid valve which opens in a filling phase to fill the respective container placed with a container mouth on the filling element and closes again at the end of the filling phase, with a back-gas tube which projects with its lower, open end beyond the underside of the filling element and is surrounded at least partly by the dispensing opening of the fluid duct, with a first gas duct that extends from the lower end of the back-gas tube into the gas space, with a controlled pressurization gas valve provided on this first gas duct, which pressurization gas valve has a valve body which in a closed position blocks the first gas duct from the gas space and in an open position opens the first gas duct to the gas space, and with gas pathways realized at least partly in the housing of the filling element, which gas pathways can be controlled by means of a control valve, wherein a second gas duct holds a gas at a second gas pressure which is greater than the first gas pressure, wherein the second gas duct can be placed in communication via the control valve and a first gas pathway with the interior of the container that is fastened to the filling element, and wherein the pressurization gas valve is realized such that its valve body opens automatically when the gas pressure in the first gas duct exceeds a specified pressure threshold which is higher than the first gas pressure but lower than the second gas pressure; and said method comprising the steps of:

establishing a first predetermined pressure in a bottle;

flushing the bottle with a first gas;

establishing a second predetermined pressure in the bottle;

establishing a third predetermined pressure in the bottle with a second gas;

filling the bottle with liquid to substantially a first predetermined level;

stopping entry of liquid into the bottle upon reaching substantially the first predetermined level;

pressurizing the bottle to drive liquid in the bottle out of the bottle; and removing liquid from the bottle until a second predetermined level is reached.

19. The method according to claim 18, wherein said gas comprises an inert gas.

20. The method according to claim 19, wherein said inert gas comprises carbon dioxide.

* * * * *

UNITED STATES PATENT AND TRADEMARK OFFICE

CERTIFICATE OF CORRECTION

PATENT NO. : 6,213,169 B1
DATED : April 10, 2001
INVENTOR(S) : Ludwig Clusserath It is certified that error appears in the above-identified patent and that said Letters Patent is hereby corrected as shown below:

Column 13,
Line 11, after 'Ludwig', delete
"Cltsserath," and substitute -- Clüsserath, --.

Signed and Sealed this

Eighth Day of January, 2002

*Attest:*

*Attesting Officer*

JAMES E. ROGAN
*Director of the United States Patent and Trademark Office*